US007878442B2

(12) United States Patent
Malecot et al.

(10) Patent No.: US 7,878,442 B2
(45) Date of Patent: Feb. 1, 2011

(54) METHOD FOR MAKING A CENTRAL UNWINDING ROLL AND RESULTING ROLL

(75) Inventors: Yves-Michel Malecot, Crosville la Vieille (FR); Joel Hungler, Ailly (FR); Jacky Postel, Aviron (FR)

(73) Assignee: Georgia-Pacific France (FR)

( * ) Notice: Subject to any disclaimer, the term of this patent is extended or adjusted under 35 U.S.C. 154(b) by 480 days.

(21) Appl. No.: 11/568,806

(22) PCT Filed: Apr. 29, 2005

(86) PCT No.: PCT/FR2005/001065

§ 371 (c)(1),
(2), (4) Date: Nov. 8, 2006

(87) PCT Pub. No.: WO2005/120997

PCT Pub. Date: Dec. 22, 2005

(65) Prior Publication Data

US 2007/0262187 A1 Nov. 15, 2007

(30) Foreign Application Priority Data

May 10, 2004 (FR) ..... 04 05022

(51) Int. Cl.
*B65H 20/00* (2006.01)

(52) U.S. Cl. ..... 242/535.3; 242/160.4; 242/522; 242/525.6; 242/526

(58) Field of Classification Search ..... 242/535.3, 242/535.1, 535, 160.4, 532.3, 526, 160.1, 242/160.2, 525, 541.2, 528, 593, 520, 588.3, 242/532.2, 541.3, 525.1, 525.6, 541, 522
See application file for complete search history.

(56) References Cited

U.S. PATENT DOCUMENTS 5,746,379 A * 5/1998 Shimizu ..... 242/160.1
2010/0032511 A1* 2/2010 Malecot et al. ..... 242/528

FOREIGN PATENT DOCUMENTS

JP 01308345 A * 12/1989
JP 04213541 A * 8/1992
JP 06156831 A * 6/1994

* cited by examiner

*Primary Examiner*—Michael R Mansen
*Assistant Examiner*—Juan J Campos
(74) *Attorney, Agent, or Firm*—Laura L. Bozek

(57) ABSTRACT

This invention relates to a method for the production of a coreless roll (110') including a sheet (110) of flexible, not moist, material such as a fibrous absorbent material, produced by winding of the sheet in one direction and rolling this sheet about a winding axis perpendicular to such direction, and including a central dispensing leader forming a projection along such axis relative to at least one part of the plane of one of the sides of the roll. The method is characterized in that the leader is produced by displacing a portion of the end of the sheet (110) before winding so that one of the longitudinal edges of the sheet forms an angle ($\alpha$) other than zero relative to such direction of winding, after which winding of the sheet about the axis is initiated. By preference several sheets are produced by longitudinal cutting of a wide sheet. The solution may be applied for production in particular of general wipe rolls, hand towel rolls, or toilet paper rolls.

12 Claims, 4 Drawing Sheets

Figure 1:
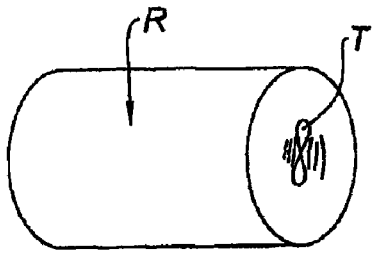
(Prior Art) Fig. 1

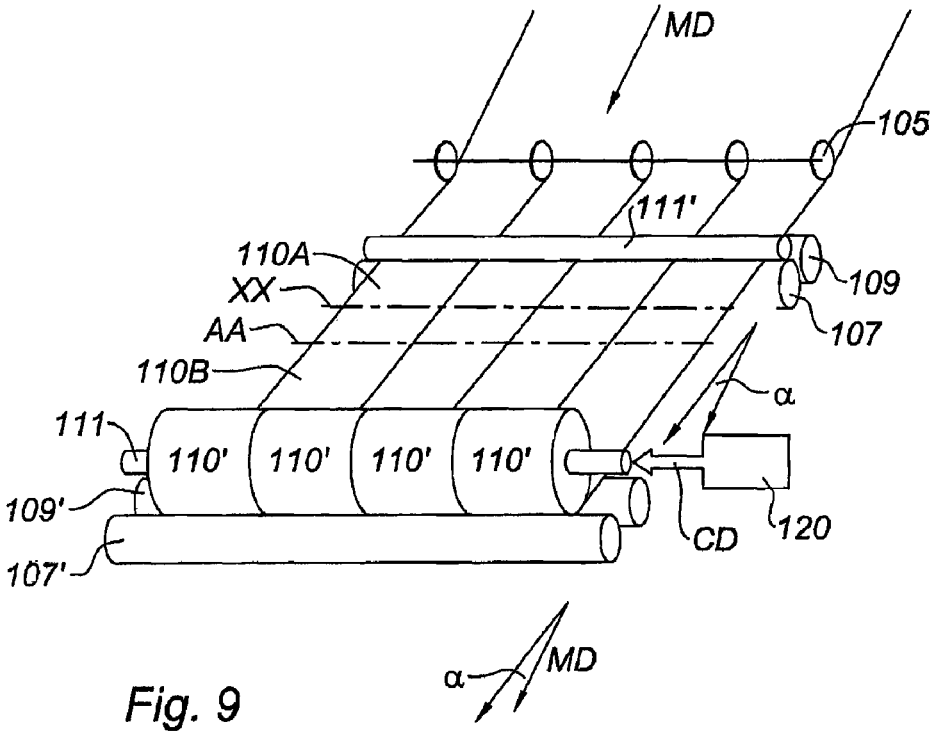
Fig. 9
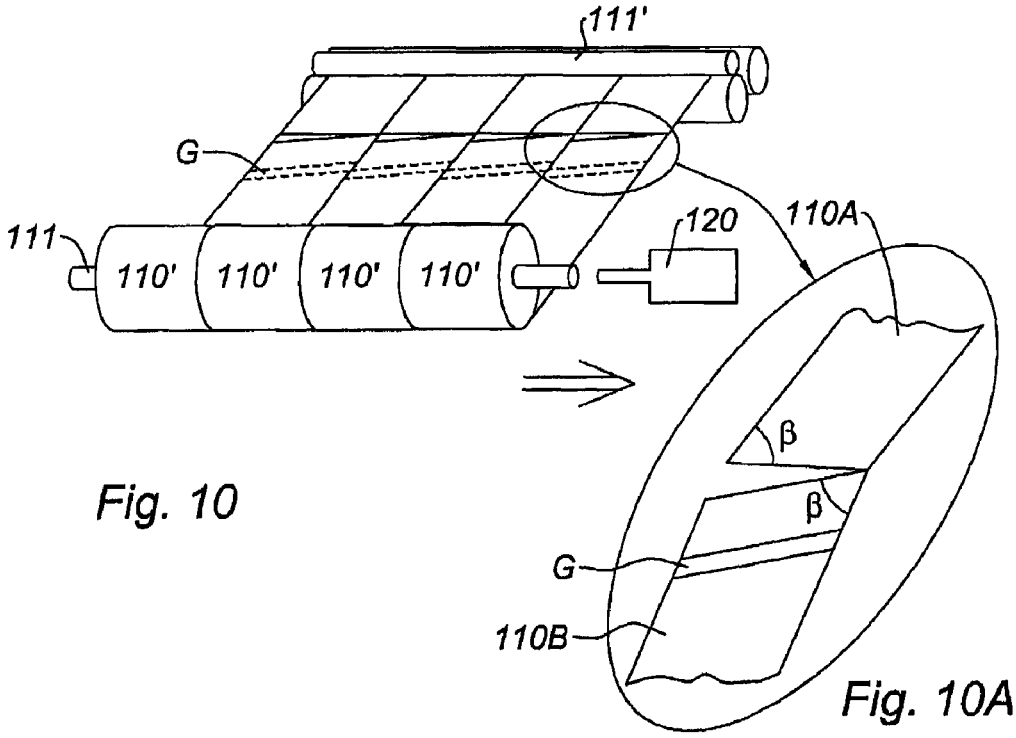
Fig. 10
Fig. 10A

METHOD FOR MAKING A CENTRAL UNWINDING ROLL AND RESULTING ROLL

The invention relates to the field of rolls of absorbent paper or other similar material such as a nonwoven material used for the purpose of wiping, for example. It relates in particular to the field of products for sanitary or home use such as wipe rolls, hand towel rolls or toilet paper rolls.

The rolls used for such applications include a continuous sheet made up of one or more plies. The sheet is optionally precut to form consecutive lengths in the direction of winding and is rolled axially, preferably around an axis which may or may not support a center core; the roll thus may or may not include a center core. The sheet may be unwound either from the outer surface of the roll in the direction of winding or from the inner surface in the axial direction perpendicular to that of the winding of the roll. In the latter case it is said that the roll is centrally unwound.

The subject matter of the present invention is represented by rolls which are centrally unwound.

When the roll includes a core it is necessary first to remove this core. Generally speaking the core is designed to permit tearing from the roll by pulling on its edge, most often at one of the ends of the helical cardboard spiral which forms the core. It has been found in practice, however, that this solution is not always satisfactory, since extraction of the core sometimes becomes difficult if the tearing area or areas are poorly formed. Furthermore, such action may unwind the first sheets of the roll which then become difficult to use. In addition, since the first windings of the sheet most often adhere to the core, they become unsuitable for use and so are considered waste.

This core is especially expensive to produce, since it generally consists of two or more layers of cardboard joined by adhesion. Most frequently production also involves "attachment" of the first winding of the roll. This winding is useless once it has been pulled off and thus becomes waste.

Coreless center-feed rolls have been proposed in order to mitigate this disadvantage. They are assumed from the outset to be easier for the user to manipulate, since it is no longer necessary to remove a core before using them. In order to produce them one may provide a temporary core during manufacture onto which the sheet is rolled. The core is then removed before the rolls are packaged. The cost of the adhesive and the core is to be added to the production expense.

In one manufacturing method not involving a core the sheet is cut off on line in the (longitudinal) direction of movement, before winding, on the basis of a master sheet of great width, and into as many strips as there are individual rolls to be produced.

In another manufacturing method the master sheet is rolled directly onto a spindle, also without interposition of a winding core. The initial sheet, which is of considerable length, is first rolled so as to form a single roll with the finished diameter of the individual roll, termed a "log" in this field. After it has been formed, the log is removed from the spindle and is separated into individual rolls.

The sheet, however, whether of tissue paper, dry or water-creped, dry method paper, or a nonwoven material, exhibits a certain amount of elasticity. Because of internal stresses in the roll due, for example, to tightening of the sheet on the spindle during winding and/or to stretching of the sheet generated by the operation of unrolling/rolling by the machine, normally it is not possible to prevent reduction of the central opening by collapse or sagging at the center of the first windings after the spindle has been removed. This collapse occurs, for example, after removal of the spindle and/or at the time the log is cut, by the pressure applied by the saw.

In any event, partial or total reduction of the central opening is observed during maintenance and transportation, as a result of the inevitable vibrations to which the rolls are subjected.

When the central opening has been completely reduced it is difficult to restore it, at least manually, and grasping of the first winding is not easy. This inevitably results in waste, especially in placing the roll in position in a dispenser, since it is then necessary to grasp several windings simultaneously.

It is known in the art how to produce rolls without a winding core, the central opening of these rolls being formed after removal of the spindle and/or cutting by a saw. Use may be made, for example, of a spindle the profile of which, grooved or polygonal, permits formation of an opening, the walls of which are self-supporting. One exemplary embodiment is illustrated by patent FR 2554799.

The central opening nevertheless is small in diameter and it is difficult to access the first windings. These windings are in the form of a compact, helicoidal twist of small "pitch" which is not easy to use. If the central opening is greater in diameter, it is difficult to prevent the first windings from being joined to each other. For this reasons use is made of a bonding agent which is deposited directly on the sheet or indirectly by way of the spindle or one of the winding cylinders by a suitable system at the time of rolling of the first windings onto the spindle. Any other principle of joining the first windings to each other, especially by a mechanical method, may be applied. The first windings, which together resist the force of the internal stresses, are thus strengthened.

In this instance as well, however, waste cannot be prevented when such a roll is placed in service. It is necessary first to remove the first joined windings whether in the case of direct use or in the case of use of this roll in a central dispensing device in which the end of the sheet must be introduced into a relatively narrow dispensing orifice.

In this last-mentioned type of embodiment as well it is not possible to keep some rolls from being jolted during shipping, with the result of collapse of the central opening as in the cases mentioned in the foregoing. To avoid this eventuality provision is made to pack the rolls preferably in cardboard boxes, unlike the rolls with a winding core for which a flexible paper or plastic envelope is sufficient. The cost is considerably increased.

The interest which might be found in these coreless rolls rather than the rolls with a winding core is thus greatly reduced.

Hence the subject matter of the invention is a coreless roll made up of a sheet of flexible material, such as an absorbent fibrous material of total grammage ranging from 15 to 300 $g/m^2$, preferably from 15 to 100 $g/m^2$, formed by rolling about a winding axis, which does not exhibit the disadvantages referred to in the foregoing.

The absorbent material may be tissue paper, dry or water-creped, dry method paper, or a nonwoven material. It may include one or more plies, joined together or not, optionally precut to form individual lengths.

The material is in the dry state. It is not moist; in particular it is not impregnated with a lotion or any other liquid.

On Jun. 12, 2003 the applicant submitted PCT/FR03/01776, a patent application relating to a roll comprising a center winding leader in the form of a center winding projection along the winding axis in question relative to at least one part of the plane of one of the sides of the roll.

The invention claimed in this patent application relates in particular to rolls of which winding is conducted under conditions of high stress applied to the sheet and clamping force applied to the winding support which make it possible to produce rolls of great length in meters but which inevitably result in reduction of the central opening.

In particular the center unwinding leader is made up of a portion of the internal end of the sheet forming the individual roll.

The solution claimed for the invention disclosed in this patent application makes it possible to eliminate all the problems associated with reduction of the center opening, since access to the first sheet from the outside the roll is provided. As a result, it is no longer necessary to interconnect the first windings in an attempt to maintain the opening as shaped. Waste is thereby prevented both at the level of the production machine because of the absence of a system for joining the first windings and at the time the roll is put to use. The rolls may be in simple flexible containers, especially ones of plastic.

This leader is formed in particular by transverse folding of a portion of the end of the sheet onto the roll winding axis; the leader accordingly having a tapered shape. This affords the additional advantage of facilitating introduction of the leader end into the dispensing device of a center-feed dispenser, for example.

The present application relates to a new method representing a variation of the methods described in the earlier application submitted by the applicant.

It is claimed for the invention that the method of producing a coreless roll made up of a sheet of a flexible material which is not moist, such as an absorbent fibrous material made by unwinding the sheet in one direction and rolling it around a winding axis perpendicular to such direction and comprising a center unwinding leader forming a projection along such axis in relation to at least one part of the plane of one of the sides of the roll. It is characterized in that the leader is produced by displacing a portion of the end of the sheet before rolling so that one of its longitudinal edges forms an angle other than zero relative to the respective winding direction, after which the sheet is rolled about the axis.

Rolling of the sheet is preferably executed on a winding support such as a spindle. In particular, the end portion is formed by cutting the sheet transversely relative to the direction of winding.

This method affords the advantage that it may be applied very simply on an existing industrial assembly by introducing minor changes into the latter.

Specifically, the method comprising the stages of roll production by rolling the sheet perpendicularly about a winding axis, in which stages: the sheet is positioned so that it extends perpendicularly on both sides of the winding axis, the sheet is cut off crosswise in relation to the direction of winding so as to form an end portion, the end portion of the sheet is folded onto the winding axis of the roll, this end portion of the sheet is kept on the winding axis, the sheet is set in rotation about the axis so as to effect rolling, is characterized in that, before the transverse cut is executed, a part of the sheet is positioned so that one of its longitudinal edges forms an angle ($\alpha$) other than zero in relation to the winding direction (machine direction)(MD).

In one preferred embodiment a wide sheet of flexible material is cut in parallel to the direction of the winding into a plurality of individual sheets positioned side by side, a part of such sheets being displaced laterally, such sheets are cut transversely to the direction of winding in order to form the end portions, such sheets are rolled about the axis, and each of the rolls is separated after being formed, each of the leaders thus being freed.

Another characteristic is such that, after the roll or rolls has or have been wound, rotation of the sheet or sheets about the respective axis is stopped, the roll or rolls is/are displaced by unwinding the sheet a first specific distance in the machine direction (MD), the roll or rolls is/are rotated in the direction opposite the initial winding direction in order to unwind a given amount of sheet, the roll or rolls is/are displaced a second predetermined distance in the direction (CD) of their axis, the sheet or sheets is/are cut off between the roll or rolls and the cylinders transversely to such winding direction.

More generally speaking, the movements and rotation are combined and modified so as to prevent any sheet damage.

In one embodiment with winding support, in which the sheet is rolled perpendicularly about a winding support, the method comprises stages in which the sheet is positioned so that it extends perpendicularly on both sides of the winding support. The sheet is cut off transversely in relation to the direction of unwinding so as to form an end portion. The end portion of the sheet is folded onto the winding support of the roll. This end portion of the sheet is kept on the winding support. The winding support is set in rotation about its axis so as to roll the sheet.

This method is characterized in that, before such transverse cut is executed, a portion of the sheet is positioned so that one of its longitudinal edges forms an angle other than zero with the direction of winding.

Another characteristic is such that a portion of the sheet is displaced laterally in relation to the direction of winding. The winding support is positioned relative to the sheet so that a portion of the latter is positioned on one side of the support and the remainder of the sheet on the other. The sheet is cut off crosswise so as to form an end portion. The end portion is returned to the support, and the sheet is wound.

The method preferably is applied when a wide sheet of flexible material is cut lengthwise into a plurality of individual sheets positioned side by side. It is then characterized by the following stages:

a portion of the respective sheets is displaced laterally, the support is positioned on the sheet portions, the sheets in question are cut off crosswise in relation to the direction of winding in order to form end portions, the sheets in question are rolled around the winding support, and each of the rolls is separated after they have been formed, thus freeing the leader of each of the rolls.

In one preferred embodiment, after the roll or rolls has/have been formed, rotation of the winding support is stopped, the support is displaced by rolling the sheet or sheets a first predetermined distance in parallel with the direction of winding, the support is set in rotation in the direction opposite that of initial winding in order to unwind a given amount of sheet, the support is displaced a second predetermined distance in parallel with its axis, a new unwinding support is placed in positioned on the sheet or sheets, the sheet or sheets is/are cut off between the roll and the new winding support crosswise in relation to the respective direction of winding.

In order to make the operation more reliable, the movements and rotation are combined so as to prevent any sheet damage.

Another characteristic is such that, before the sheet or sheets is/are cut off, adhesive is applied to the part of the sheets forming the tail of the sheet or sheets.

Another characteristic is such that, after the sheets have been cut off, the longitudinal edges of the tail portion of the rolls are realigned with the edges of the rolls, specifically by displacement of the winding support or of the tail portion in the opposite direction.

The leader preferably is made on the side opposite that on which the support is removed, in order to limit the stresses of friction of the sheets in contact with the support and to facilitate removal of the latter.

The invention also relates to the roll obtained by the method. The length of the leader is at least 0.3 cm and preferably ranges from 1 to 15 cm. Specifically, it is tapered in shape as is the tail of the rolls.

Lastly, the adhesive is applied in parallel with the non-longitudinal side of the tail portion of the rolls.

Figure 2:
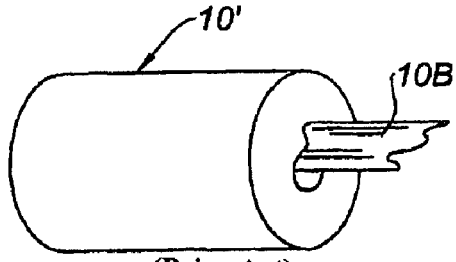
(Prior Art) Fig. 2
Figure 3:
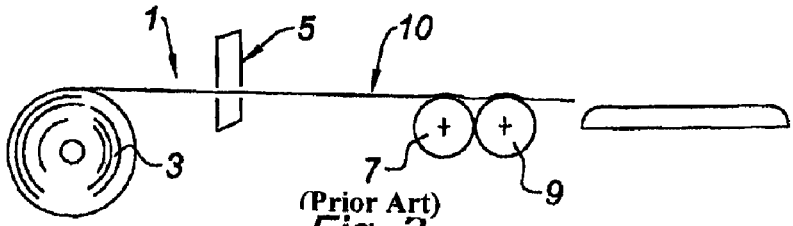
(Prior Art) Fig. 3
Figure 4:
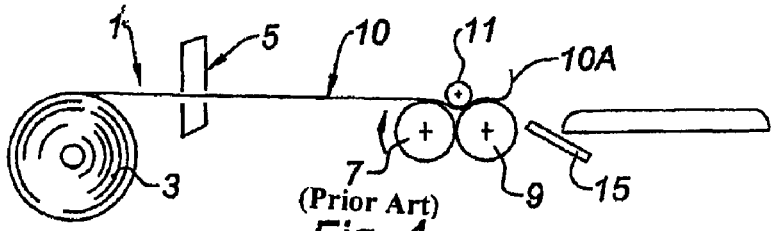
(Prior Art) Fig. 4
Figure 5:
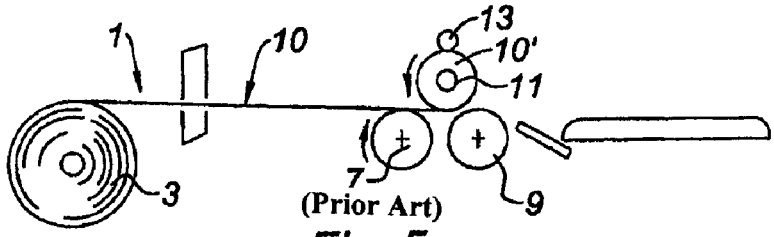
(Prior Art) Fig. 5
Figure 6:
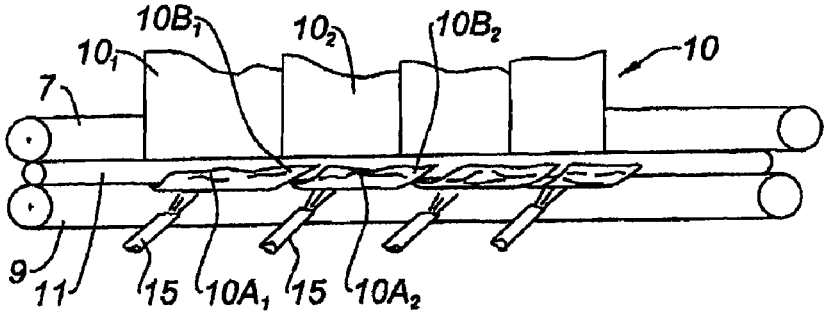
(Prior Art) Fig. 6
Figure 11:
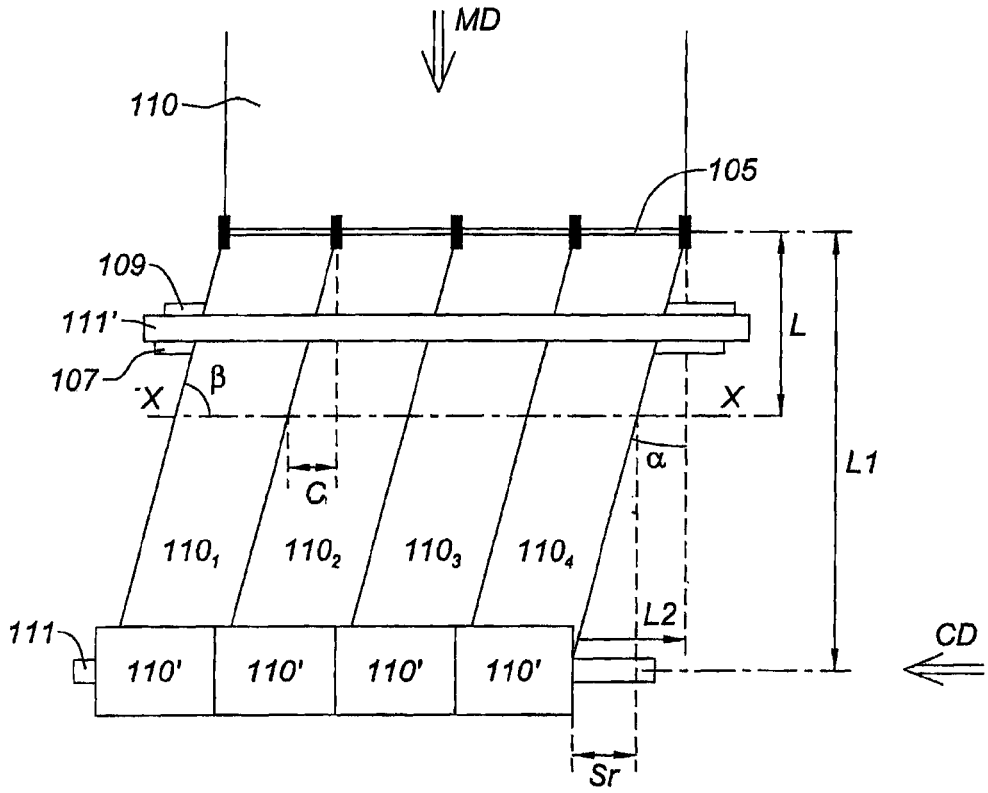
Figure 12:
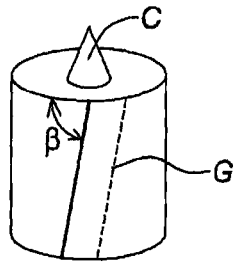

The invention will now be described in greater detail with reference to the accompanying drawings, in which FIG. 1 illustrates a coreless roll of the prior art, the central opening of which is reduced, FIG. 2 represents a roll as claimed for the invention having a center winding leader projecting along the axis in relation to one of the sides of the roll, FIGS. 3 to 5 represent in diagram form a side view of the movement of a sheet in a machine permitting production of rolls having a winding leader without use of a winding core, FIG. 6 presents a top view of the machine illustrated in FIG. 4, FIGS. 7 to 10 represent in diagram form a machine in different stages of the method claimed for the invention, FIG. 11 presents a top view of the machine in the configuration shown in FIG. 9, and FIG. 12 shows a roll obtained by the method claimed for the invention.

The roll shown in FIG. 1 is, for example, a roll (R) of absorbent paper, without winding core, used for wiping, either in the home or in a shop. By way of illustration, the paper is two-ply tissue paper each ply measuring 20 g/m$^2$, the two plies preferably being joined. The roll has been obtained by rolling a sheet of a width of 2600 mm on a winding support in the form of a spindle, such as one circular in cross-section having a diameter of 10 to 80 mm. After a roll, called a "log" in this field, 20 cm in diameter, for example, has been formed, the spindle is removed and the log is taken to a sawing station. The rolls thus produced are packaged for shipping. The roll is illustrated after the walls of the central opening have collapsed in the center direction. The opening (T) is reduced until it has been completely flattened. When the roll is put to use in a center-feed dispenser, it is necessary to free the inner end of the sheet and slide it into the dispensing orifice. It is to be seen that this operation is difficult in this instance, since it is necessary to pull on the first windings in order to free this end. Waste inevitably results.

FIG. 2 shows a coreless roll (10') resulting from the method claimed for the invention as described in patent application PCT/FR03/01776. The central opening is reduced as in the preceding prior art case. However, use of the roll is facilitated to a great extent by the solution claimed for the invention which consisted of forming a center winding leader (10B). In the simplest embodiment this leader, made up of a portion of the internal end of the sheet forming the end which has previously been freed, before any subsidence of the walls of the central opening, and made to project from one of the sides of the roll. This leader may be formed either at the time of formation of the roll just before or during rolling of the sheet or after production of the roll when the opening is still being formed, that is, just after cutting, in any event preferably a short time afterward, as is specified in application PCT/FR03/01776.

It is advantageous for this leader (10B), 0.3 to 20 cm long, preferably 1 cm to 15 cm, to be formed from a portion of the internal end of the sheet which has been folded in the direction of the winding axis of the roll and made to project from the side. This leader thus forms a means of gripping at the tip which is flexible at its end and which may easily be folded back against the side of the roll to prepare for packaging of these rolls before shipping. The tip is also easy to handle and may easily be introduced into a dispenser. The length selected for the leader is based in particular on the ease with which it may be gripped and with which it may be introduced into the extraction orifice of a dispenser. The length of the leader corresponds to the distance between the leader and the side of the roll.

The leader may be strengthened by means of a supplementary element such as coloring.

In one embodiment, not illustrated, the leader may be reinforced mechanically by means of a tab, or any suitable means or additional element applied to the sheet and fitted to project from the axis of the roll.

The added element is then positioned on the end of the sheet before winding or after separation of the rolls, so as to project from one of the sides of the roll.

One method of producing rolls as specified in application PCT/FR03/01776 is described in what follows with reference to FIGS. 3 to 6, which illustrate the essential elements of a machine for producing rolls.

This machine is used to cut off in a line a wide sheet 1 coming from a master roll (3), before being rolled onto a spindle (11). The width of the sheet in the sphere of absorbent paper products is, for example, 2600 mm. The sheet is cut in the longitudinal direction of winding by means of disks (5) positioned in parallel, into a plurality of individual sheets the width of which corresponds to the width of the individual rolls which one wishes to obtain. The cutting means may consist of a series of disks positioned vertically or of disks operating in conjunction with a support cylinder and cutting the sheet. Other means are known to the expert.

The sheets (10) are pulled toward a device having two parallel cylinders (7 and 9) made to rotate by motive means not shown. The two cylinders are spaced a small distance from each other. Once the sheets (10) have reached the position shown in FIG. 3, a spindle (11) forming a winding spindle is placed in position by suitable means. The spindle presses the sheet against the cylinders (7 and 9), as is illustrated in FIG. 4. It spans the space made between these two adjoining driving cylinders. The spindle thus delimits a part of the end (10A) of the sheets (10) on one side. In order to initiate rolling of sheets onto the spindle, means (15) are provided which fold the end portion (10A) onto the spindle. Such means may consist of one or more suitably oriented air streams. A pressing roller (13) is then lowered to keep the end (10) of the sheets against the spindle. The cylinders (7 and 9) are set in rotation after the various components have been placed in position. These cylinders cause the spindle to rotate and the roller 13 pressing against them permits winding of the sheet as is to be seen in FIG. 5.

Once the winding stage has been completed, the pressing roller is removed and the spindle and its rolls (10') are moved to the following station, at which the individual sheets are cut, in parallel with the winding axis, over the entire width of the master sheet, downstream from the cylinders (7 and 9). The spindle is then removed from the unit made up of the rolls (10').

In order to produce a leader at the time of rolling of the sheets, as is to be seen in FIG. 6, which is a top view of the assembly corresponding to the illustration in FIG. 4, the spindle (11) is positioned on the two cylinders (7 and 9) and applies pressure to the sheet. The sheets ($\mathbf{10}_1$, $\mathbf{10}_2$, . . . ) are positioned below the spindle (11) and their end portions ($\mathbf{10A}_1$, $\mathbf{10A}_2$, . . . ) are folded transversely on this spindle.

These means (15), in this instance consisting of air streams, are inclined at an angle to the axis of rotation of the spindle so as to impart to these end portions transverse movement relative to the direction of displacement of the sheets. These end portions (10$A_1$, 10$A_2$, . . . ) are thus moved in the direction of the winding axis. Consequently, each end portion, (10$A_1$), for example, extends beyond the side in the direction of the adjacent sheet (10$A_2$). Once they have reached this position, the pressing roller (13) immobilizes the various end portions (10$A_1$, 10$A_2$, . . . ) against the spindle (11). Winding may begin. During the winding, the projecting part (10$B_1$, 10$B_2$, . . . ) of the end portion of each of the sheets is pressed between the spindle and the first spire of the adjacent roll.

The projecting part is freed when the spindle is removed. This part (10$B_1$, 10$B_2$, . . . ) then makes up the center winding leader for the roll.

The method claimed for the invention will now be described with reference to FIGS. 7 to 10, which illustrate the successive stages. The same elements are involved, "100" being added to the same reference numbers.

Figure 7:
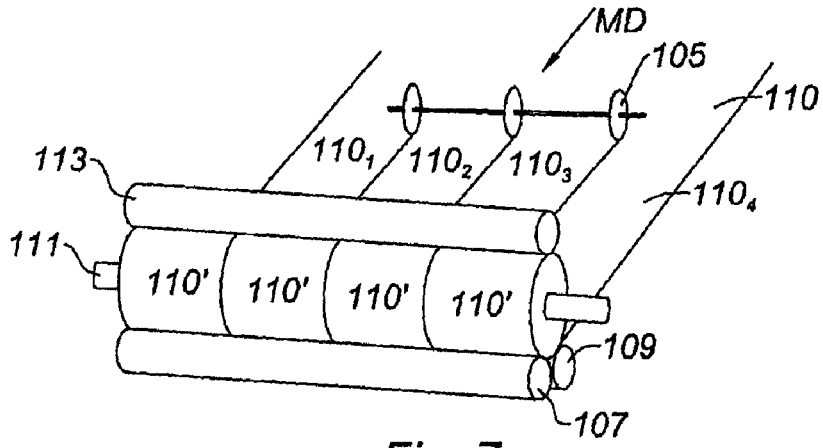

FIG. 7 shows four rolls (110') in the method of formation by winding of sheets (110$_1$ to 110$_4$). The number of rolls may vary. The sheets are cut from a wide sheet (110) in the direction of winding (MD) of this sheet by cutting means represented diagrammatically by disks (105). Such means are mounted on a winding spindle or support (111) which is set in rotation in the direction indicated by the arrows by the two cylinders (107 and 109) on which the means are mounted. The cylinders (107 and 109) themselves are set in rotation by motive means not shown. A pressing cylinder (113) ensures cohesion of the unit as a whole.

Figure 8A:
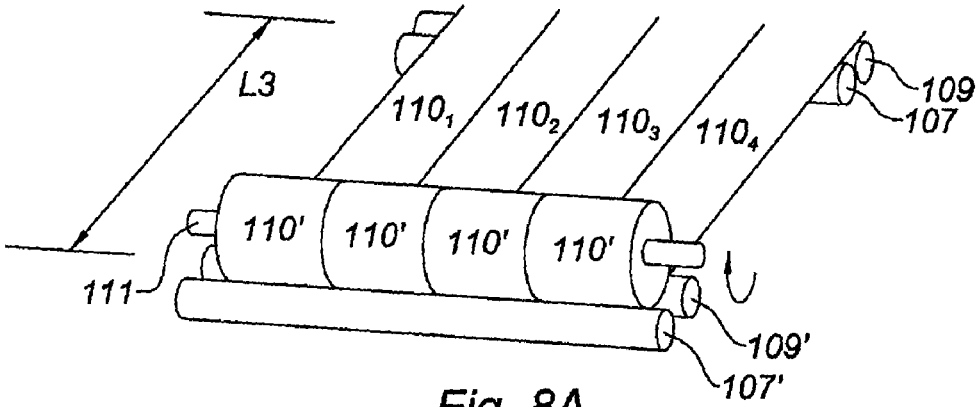
Figure 8B:
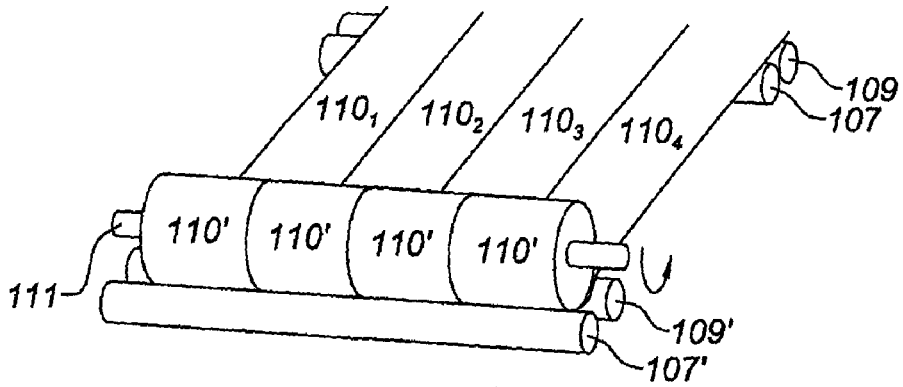

FIGS. 8A and 8B illustrate rolling after completion. The unit as a whole with the spindle has been moved a specific distance (L3) in the direction of unwinding referred to in the foregoing, this allowing the sheets to be unwound. The rolls with the spindle have been positioned on supports (107' and 109'). The supports (107' and 109') preferably are in parallel with the cylinders (107 and 109). The spindle is rotated a fraction of a turn in the direction opposite the direction of initial winding, in the direction indicated by the arrow in FIG. 8B, in order to form a loop by winding of a specific amount of sheet.

FIGS. 9 and 11 show a jack (120) which moves the spindle (111) provided with rolls, preferably in parallel with the direction of its axis, a second specific distance in the direction indicated by the arrow (CD). The longitudinal edges of the sheets now form angle ($\alpha$) with the initial direction of winding (MD). It is to be seen in the figure that angular displacement originates at the disks (105) for longitudinal cutting of the sheet (110) which are upstream from the cylinders (107 and 109). This angular displacement preferably is effected in the same plane as that of the winding. However, the displacement, rather than being executed in two perpendicular directions, may be effected along a suitable trajectory having components at least in directions (MD) and (CD).

A new spindle (111') is positioned on the sheets at the level of the cylinders (107 and 109). The sheets thus are gripped between the spindle (111') and these cylinders. Adhesive is then deposited along a transverse line AA, preferably in parallel with the cylinders (107 and 109) which support the winding of the rolls, and the set of sheets is cut transversely along a line XX by means of a blade which preferably moves in parallel with the winding axis. The line XX is situated between the line AA and the cylinders (107 and 109), at a distance L from the cutting elements (105).

FIG. 10 shows that, after crosswise cutting of the sheets has been completed, the spindle (111) with its rolls is moved in the direction opposite that of the arrow CD over a distance ($S_r$) on the axis of the rollers sufficient to realign the tail (110B) portions of the sheets with the direction of winding. Winding of the rolls (110') is completed by immobilizing the terminal extremities or tail portions (110B) of the sheets to which adhesive G has been applied so that the longitudinal edges of these tail portions (110B) are aligned as precisely as possible with those of their respective roll.

It is found in the case both of the tail portion (110B) and of the tail end portion (110A) that the edges generated by transverse cutting do not form a right angle with the longitudinal edges (110) of the sheets. The end portion (110A) which forms the leader thus exhibits a tapered shape contributing to easier introduction into a dispensing orifice of a dispensing device. The tail portion (110B) is also tapered and is a characteristic of this method.

The rolls are completed. The spindle is separated from the rolls and the leaders are freed by moving the rolls away from each other.

The machine is now ready to wind a new series of rolls. The first stage then consists of lowering the end portions (110A) onto the spindle. Because of their tilt relative to the direction of winding of the sheet (angle $\alpha$), each of these sheet portions (110A) folded onto the spindle forms a leader and overlaps the adjacent roll. The remainder of the sheets which have not undergone this lateral displacement is wound while remaining perpendicular to the axis of the spindle to form the rolls.

It is to be seen that, in comparison to a roll winding assembly of the prior art, it has sufficed to include a jack (120) which controls axial displacement of the spindle over a short distance. The length of the dispensing leader depends on the distance of displacement of the spindle (111) in the axial direction.

By way of example, products were made on an industrial machine. The positioning of the various elements shown in FIG. 11, which is a top view of the machine, was the following:

distance L1 between the cutting elements (105) and the position on the supports (107' and 109'): 700 mm, second distance L2, that of displacement of the rolls along the axis CD: 160 mm, cutting distance along XX: 260 mm.

A leader length C of around 60 mm (C=L2×L/L1) is obtained.

The distance Sr over which the spindle with the rolls is moved in order to realign the tail portions is given by the ratio Sr=L2−C, or 100 mm in this instance.

FIG. 12 shows a roll with the last sheet (110B) the transverse edge of which is inclined toward the sides of this sheet at an angle ($\beta$). It is to be seen that when the cutoff line XX is perpendicular to MD this angle complements angle ($\alpha$). In this example angle ($\beta$) is 77° and angle ($\alpha$) 13°.

The invention claimed is:

1. A method of forming a coreless roll including a sheet of flexible material, the method comprising:

positioning at least one end portion of a sheet of flexible material upon a first winding spindle defining a winding axis, the at least one end portion having first and second longitudinal edges;

displacing the at least one end portion along the winding axis such that at least one of the first and second longitudinal edges forms an angle ($\alpha$) other than zero relative to the winding axis;

cutting the sheet of flexible material transversely to form at least one angled end portion; and winding the sheet of flexible material starting with the at least one angled end portion about a second winding spindle to form a roll having a center portion, at least a portion of the at least one angled end portion projecting from the center portion of the roll to form a leader.

2. The method of claim 1, wherein winding the sheet of flexible material to form the roll includes rolling the sheet of flexible material on the second winding spindle.

3. The method of claim 1, further comprising:

cutting the sheet of flexible material along an axis perpendicular to the winding axis to form a plurality of flexible sheets each having a corresponding at least one end portion.

4. The method of claim 3, wherein displacing the at least one end portion relative to the winding spindle includes displacing the end portion of each of the plurality of flexible sheets.

5. The method of claim 4, wherein cutting the sheet of flexible material includes cutting the plurality of end portions transversely to form a corresponding plurality of angled end portions.

6. The method of claim 1, further comprising:

supporting the roll on at least one cylinder that extends parallel to the second winding spindle;

shifting the roll relative to and away from the at least one cylinder in a direction substantially perpendicular to the second winding spindle and supporting the roll on at least one support; and subsequent to the shifting and supporting, positioning a third winding spindle adjacent the at least one cylinder, the sheet of flexible material extending between the at least one support and the at least one cylinder.

7. The method of claim 6, further comprising:

displacing the roll along the second winding spindle relative to the at least one cylinder.

8. The method of claim 7, further comprising:

cutting the sheet of flexible material transversely between the at least one support and the at least one cylinder to form the at least one angled end portion and at least one angled tail portion, the at least one angled tail portion being associated with the roll.

9. The method of claim 8, further comprising:

applying adhesive to the at least one angled tail portion.

10. The method of claim 9, wherein applying adhesive to the at least one angled tail portion includes applying adhesive in a direction substantially parallel to the winding axis.

11. The method of claim 8, further comprising:

aligning longitudinal edges of the at least one tail portion with corresponding edges of the roll.

12. A method of forming a coreless roll including a sheet of flexible material, the method comprising:

positioning at least one end portion of a sheet of flexible material upon a first winding spindle defining a winding axis, the at least one end portion having first and second longitudinal edges;

displacing the at least one end portion along the winding axis such that at least one of the first and second longitudinal edges forms an angle ($\alpha$) other than zero relative to the winding axis;

cutting the sheet of flexible material transversely to form at least one angled end portion;

winding the sheet of flexible material starting with the at least one angled end portion about a second winding spindle to form a roll having a center portion, at least a portion of the at least one angled end portion projecting from the center portion of the roll to form a leader;

supporting the roll on at least one cylinder that extends parallel to the second winding spindle;

shifting the roll relative to and away from the at least one cylinder in a direction substantially perpendicular to the second winding spindle and supporting the roll on at least one support; and subsequent to the shifting and supporting, positioning a third winding spindle adjacent the at least one cylinder, the sheet of flexible material extending between the at least one support and the at least one cylinder.

* * * * *